United States Patent [19]

Jackson et al.

[11] 4,429,751

[45] Feb. 7, 1984

[54] CONTROL SYSTEM FOR PILE HAMMERS

[75] Inventors: E. Don Jackson, Kansas City, Mo.; Ralph E. Myers, Kansas City, Kans.

[73] Assignee: Conmaco, Inc., Kansas City, Kans.

[21] Appl. No.: 314,584

[22] Filed: Oct. 26, 1981

[51] Int. Cl.[3] ..... B23Q 5/00; E21C 5/00

[52] U.S. Cl. ..... 173/13; 173/116; 173/135; 173/139; 91/268; 91/272

[58] Field of Search ..... 173/3, 13, 14, 4, 133, 173/134, 135, 138, 139; 91/268, 272, 410, 403

[56] References Cited

U.S. PATENT DOCUMENTS

| | | | |
|---|---|---|---|
| 3,082,746 | 3/1963 | Kerridge | 91/405 |
| 3,133,472 | 5/1964 | Zollinger | 173/135 |
| 3,881,554 | 5/1975 | Cooley et al. | 173/13 |
| 4,062,411 | 12/1977 | Adkins et al. | 173/134 |

*Primary Examiner*—E. R. Kazenske

*Assistant Examiner*—Hien H. Phan

*Attorney, Agent, or Firm*—Schmidt, Johnson, Hovey & Williams

[57] ABSTRACT

An automatic, fluid actuated, external control system for a pile hammer or the like is provided that can vary the operating stroke length of a pile hammer and that can be used to operate the pile hammer in either a continuous or single stroke mode. A series of axially spaced orifices in the hammer housing exhaust pressurized fluid from the housing in a sequence controlled by the position of the hammer piston within the housing. The orifices are coupled by conduit to a series of pressure sensitive valves external of the pile hammer. The pressure sensitive valves control the delivery and exhaust of pressurized motive fluid to and from the pile hammer in response to the position of the hammer piston within the hammer housing.

3 Claims, 6 Drawing Figures

CONTROL SYSTEM FOR PILE HAMMERS

BACKGROUND OF THE INVENTION

1. Field of the Invention

This invention relates to an automatic pressurized fluid actuated control system that is used external of and in conjunction with a pile hammer or the like. More particularly, it is concerned with a pile hammer control system having a series of pressure sensitive interconnected valves. The control system is connected by conduit to orifices in the pile hammer housing, and the orifices, conduit and valves are arranged so as to control the sequence that pressurized motive fluid is delivered to and exhausted from the pile hammer.

2. Description of the Prior Art

Pile hammers and the like are typically operated by introduction of a pressurized fluid, commonly steam or compressed air, into a chamber having a movable piston therein. When the pressurized fluid has raised the piston to a predetermined height within the chamber, the pressurized fluid is exhausted from the chamber, and the piston falls to deliver an impact to the pile or other object being driven. It is axiomatic that the proper operation of a pile hammer requires that pressurized fluid be delivered to and exhausted from the chamber in an operational sequence determined by the position of the hammer piston within the chamber. Conventional pile hammers control the operational sequence by use of a slide bar and trip mechanism that mechanically actuate the exhaust valve when the hammer piston has been fully extended within the hammer chamber. The slide bar and trip mechanism present several disadvantages in that the mechanical parts are typically bulky and heavy, are integral to the hammer and therefore subject to extreme jarring from the hammer impact, and do not allow for variations in the operating stroke length of the hammer. Although there are some pile hammer control systems in the art that eliminate the need for a slide bar trip mechanism (see U.S. Pat. No. 3,645,342 issued to George C. Wandell), there have heretofore been no control systems that can be located external of a pile hammer, that are fluid actuated rather than mechanically actuated, or that allow for an adjustment in the hammer stroke length.

SUMMARY OF THE INVENTION

The pile hammer control system in accordance with the present invention broadly includes a supply valve for controlling flow of motive fluid to the housing of the pile hammer, an exhaust valve for controlling discharge of motive fluid from the hammer housing, a control assembly of pressure sensitive valves for controlling the opening and closing of the supply and exhaust valves, conduit interconnecting the hammer housing, supply valve, exhaust valve, and control assembly, and pressure regulation valves for controlling fluid pressure.

In particularly preferred forms the control assembly includes a first valve for opening the hammer exhaust valve when the hammer piston has been fully raised within the chamber, a second valve for maintaining the hammer exhaust valve in a closed position while the hammer piston is being raised within the chamber, a third valve for maintaining the hammer supply valve in an open position so that motive fluid may be introduced into the chamber for raising the hammer piston, and a fourth valve for closing the hammer supply valve when the piston has been raised to a predetermined height. The conduit interconnecting the various valves is arranged such that the control valves open and close the hammer supply and hammer exhaust valves in the proper predetermined operational sequence.

DESCRIPTION OF THE PREFERRED EMBODIMENT

Figure 2:
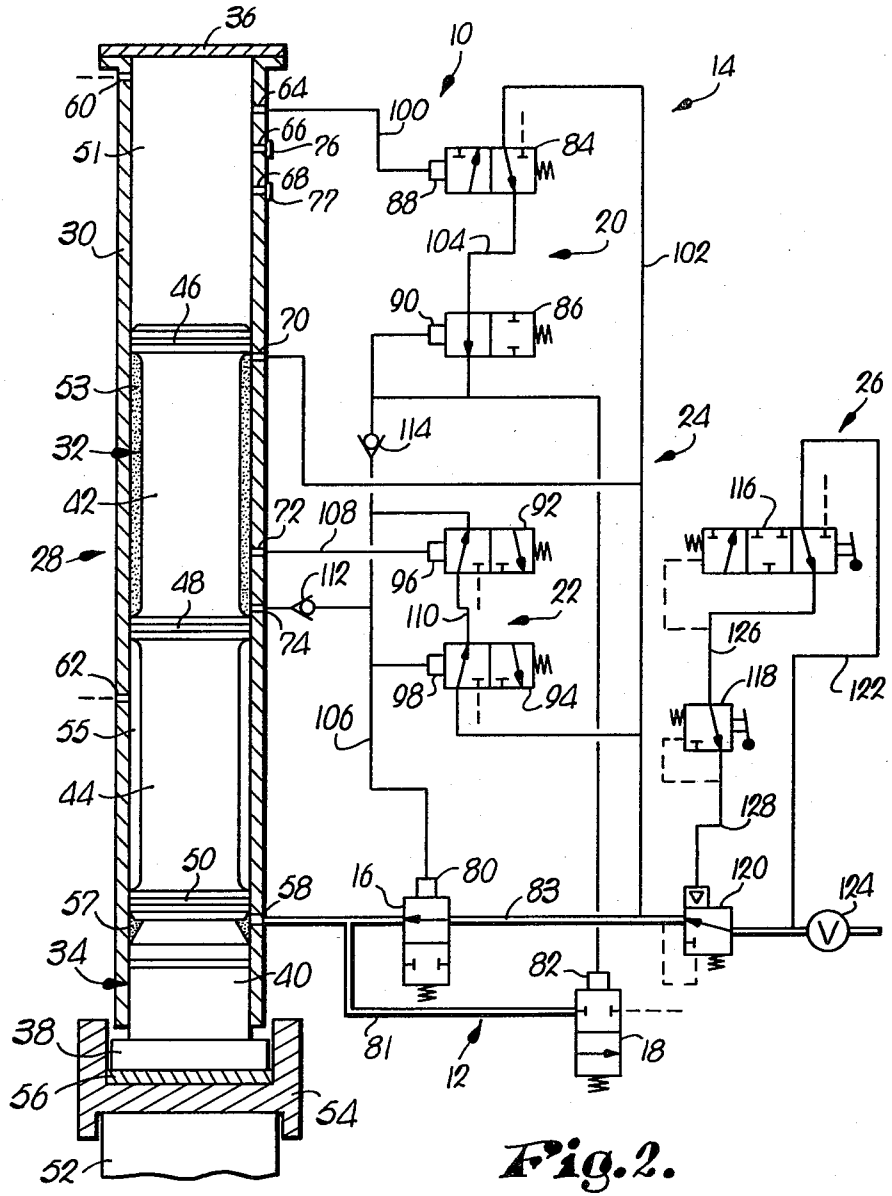
FIG. 2 is similar to FIG. 1 but shows the control system and pile hammer in their respective configurations upon initial charging of the control system.

Referring to the drawings, a control system 10 in accordance with the invention broadly includes a motive fluid valve assembly 12 and a control assembly 14. The motive fluid valve assembly 12 includes a supply valve 16 and an exhaust valve 18. The control assembly includes an exhaust valve control means 20 and a supply valve control means 22. A plurality of control valve conduits broadly indicated by the number 24 operatively couple the exhaust valve control means 20, the supply valve control means 22, the supply valve 16, and the exhaust valve 18. A pressure regulation system 26 is operatively connected to the control system 10.

The control system 10 is shown, for explanation purposes, connected to a pile hammer 28, but the application of the control system 10 is not limited to the type of pile hammer shown in FIGS. 1–6. The pile hammer 28 broadly includes a cylindrical housing 30, a piston 32 within the housing 30 and an anvil 34 partially received within the housing 30.

The pile hammer housing 30 is a metallic tubular member having a uniform inner diameter throughout. A head 36 seals the upper end of the housing 30 and is fastened by any suitable means such as by bolts (not shown). The anvil 34 includes a flange 38 external of the housing 30 and a cylindrical portion 40 telescopically received within the lowermost end of the housing 30. Portion 40 of the anvil 34 has a diameter corresponding to the inner diameter of the housing 30, such that the anvil 34 is moveable within the housing 30 but there exists an airtight seal defined by the anvil portion 40 and the inner surface of the housing 30.

Piston 32 is shiftably received within the housing 30 and is a solid metallic, generally columnar structure. The diameter of the piston 32 is irregular such that the outer surface of the piston 32 is divided into two equal sections 42, 44 by means of three laterally spaced apart housing surface engaging rings 46, 48, 50. The diameter of rings 46, 48, 50 corresponds to the inner diameter of the housing 30 such that four separate cavities 51, 53, 55, 57 are defined by the cooperative structure of housing 30 and piston 32.

The pile hammer 28 is shown in conjunction with a pile 52. A pile engaging cap 54 which includes a cushioning material 56 is interposed between the pile 52 and the flange 38 of anvil 34.

A supply/exhaust port 58, first and second control air vents 60, 62, three hammer fully raised sensing orifices 64, 66, 68, control air supply port 70, a hammer partially raised sensing orifice 72 and a hammer fully down sensing orifice 74 are provided through the housing wall 30. Airtight removable plugs 76, 78 are received within the hammer fully raised sensing orifices 66, 68 respectively.

The supply valve 16 includes a pressure sensitive pilot 80 and is a two-position valve, spring biased to the normally closed position. The exhaust valve 18 includes a pressure sensitive pilot 82 and is a two-position valve, spring biased to the normally open position. A first motive fluid conduit 81 connects the supply valve 16, the exhaust valve 18, and the supply/exhaust port 58. A second motive fluid conduit 83 connects the supply valve 16 and the pressure regulation system 26.

The exhaust valve control means 20 includes a first and second valve 84, 86. First valve 84 includes a pressure sensitive pilot 88 and is a two-position valve, spring biased to the normally open position. Second valve 86 includes a pressure sensitive pilot 90 and is a two-position valve, spring biased to the normally closed position. Supply valve control means 22 includes a third and fourth valve 92, 94. Third valve 92 includes a pressure sensitive pilot 96 and is a two-position valve, spring biased to the normally closed position. Fourth valve 94 includes a pressure sensitive pilot 98 and is a two-position valve, spring biased to the normally closed position.

A first conduit 100 connects the hammer fully raised sensing orifice 64 to the pilot 88 of first valve 84. A second conduit 102 connects first valve 84, control air supply port 70, fourth valve 94 and the second motive fluid supply conduit 83. A third conduit 104 connects first valve 84 to second valve 86. A fourth conduit 106 connects the hammer fully down sensing orifice 74, the pilot 90 of the second valve 86, the second valve 86, the third valve 92, the pilot 98 of the fourth valve 94, the pilot 80 of the supply valve 16, and the pilot 82 of the exhaust valve 18. A fifth conduit 18 connects the hammer partially raised sensing orifice 72 and the pilot 96 of third valve 92. A sixth conduit 110 connects the third valve 92 and the fourth valve 94.

Two check valves 112, 114 are interposed on the fourth conduit 106. Check valve 112 isolates the pilot 90 of the second valve 86, the second valve 86, the third valve 92, the pilot 98 of the fourth valve 94, the pilot 80 of the supply valve 16 and the pilot 82 of the exhaust valve 18 from the hammer fully down sensing orifice 74. The check valve 112 is oriented to prevent the back-flow of fluid into the hammer housing 30 through the fourth conduit 106. The check valve 114 isolates the pilot 90 of the second valve 86, the second valve 86, and the pilot 82 of the exhaust valve 18 from the third valve 92, the pilot 98 of the fourth valve 94, the pilot 80 of the supply valve 16 and the hammer fully down sensing orifice 74. The check valve 114 is oriented to prevent back-flow of control fluid from the pilot 90 of the second valve 86, the second valve 86, and the pilot 82 of the exhaust valve 18 through the conduit 106 to the third valve 92, the pilot 98 of the fourth valve 94, the pilot 80 of the supply valve 16, and the supply sensing orifice 74.

Pressure regulation system 26 includes first and second regulator valves 116, 118. First regulator valve 116 is a spring biased hand operated three-position regulator valve that can regulate pressure from zero pounds per square inch to the maximum pressure available. The second regulator valve 118 is a one-position regulator valve included in the pressure regulation system for a purpose hereinafter discussed. The pressure regulation system 26 also includes a system fluid supply regulator valve 120, a seventh conduit 122 connecting the first pressure regulator valve 116 and a fluid supply source 124, an eighth conduit 126 connecting the first regulator valve 116 and the second regulator valve 118, and a ninth conduit 128 connecting the second regulator valve 118 with a system fluid supply regulation valve 120.

The operation of the control system for pile hammers is described with reference to FIGS. 1–6.

Figure 1:
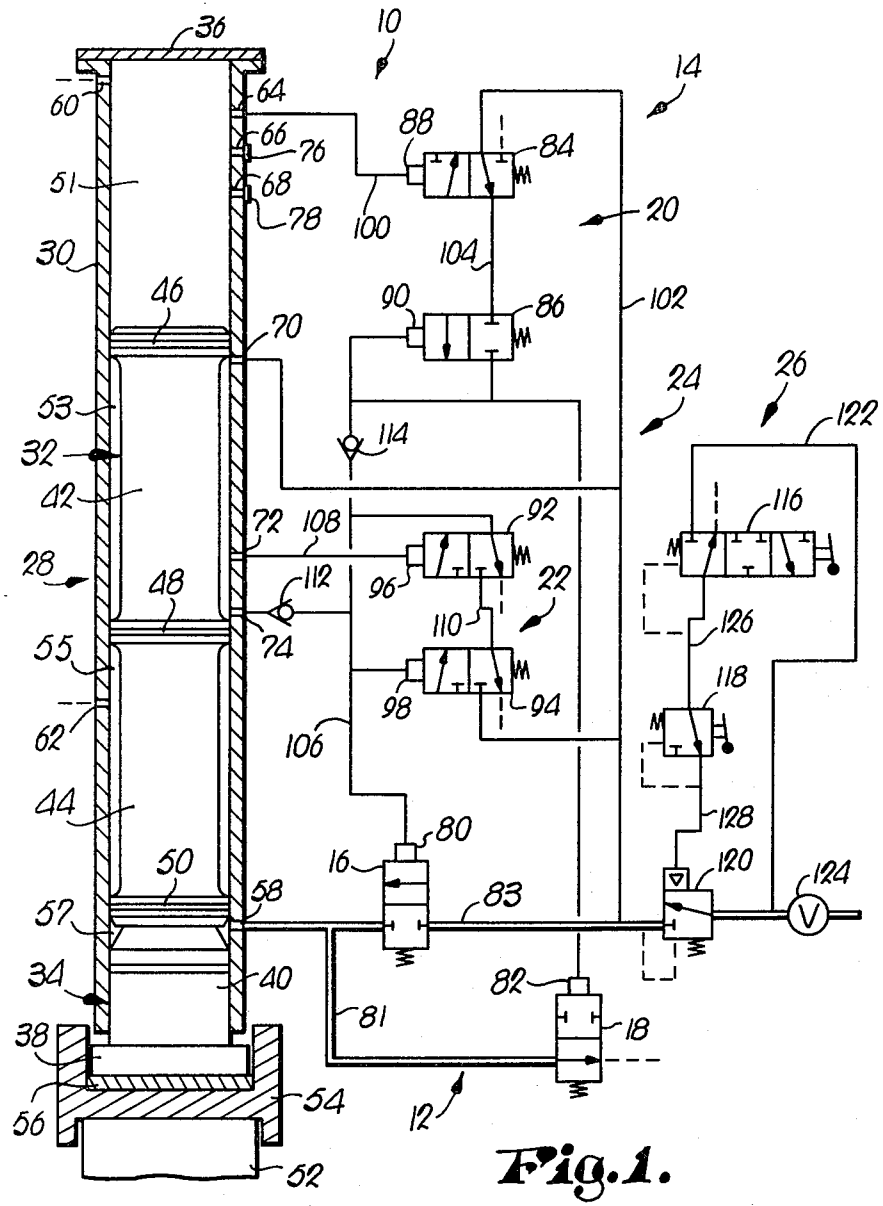
FIG. 1 is a partially schematic, partially sectional view of a pile hammer operatively connected to the control system of the present invention, with the hammer piston being in a fully down position and the control system in an uncharged state.

FIG. 1 shows the pile hammer control system 10 in its uncharged state. System supply regulator valve 120 is closed, thereby cutting off all pressure to the control system 10. With no pressure applied to the control system 10, first valve 84 and exhaust valve 18 are in a normally open configuration, valves 86, 92, 94 and supply valve 16 are in a normally closed configuration.

When valve 120 is opened, pressure is applied to the control system 10. Referring to FIG. 2, the pressure is applied through conduit 102 and orifice 70 to cavity 53, and is thereby applied through orifice 74 and conduit 106 to the pilots 90, 98, 80, 82 of the second valve 86, fourth valve 94, the supply valve 16, and exhaust valve 18, respectively. Pressure is also applied from cavity 53 through orifice 72 and conduit 108 to the pilot 96 of third valve 92. Second valve 86, third valve 92, fourth valve 94, and supply valve 80 are thereby switched to an open position and exhaust valve 18 is thereby switched to a closed position. With the second valve 86 in an open position, pressure is applied to the pilot 82 of exhaust valve 18 through normally open first valve 84 and second valve 86. With third valve 92 and fourth valve 94 in an open position, pressure is applied to the pilot 80 of supply valve 16 through third valve 92 and fourth valve 94. It will be noted that upon initial charging of the control system 10, pressure is applied to the pilot 80 of supply valve 16 through two separate conduit paths, and pressure is applied to the pilot 82 of exhaust valve 18 through two separate conduit paths. With supply valve 16 open and exhaust valve 18 closed, pressurized motive fluid is applied through orifice 58 to the housing 30, causing the piston 32 to lift.

Figure 3:
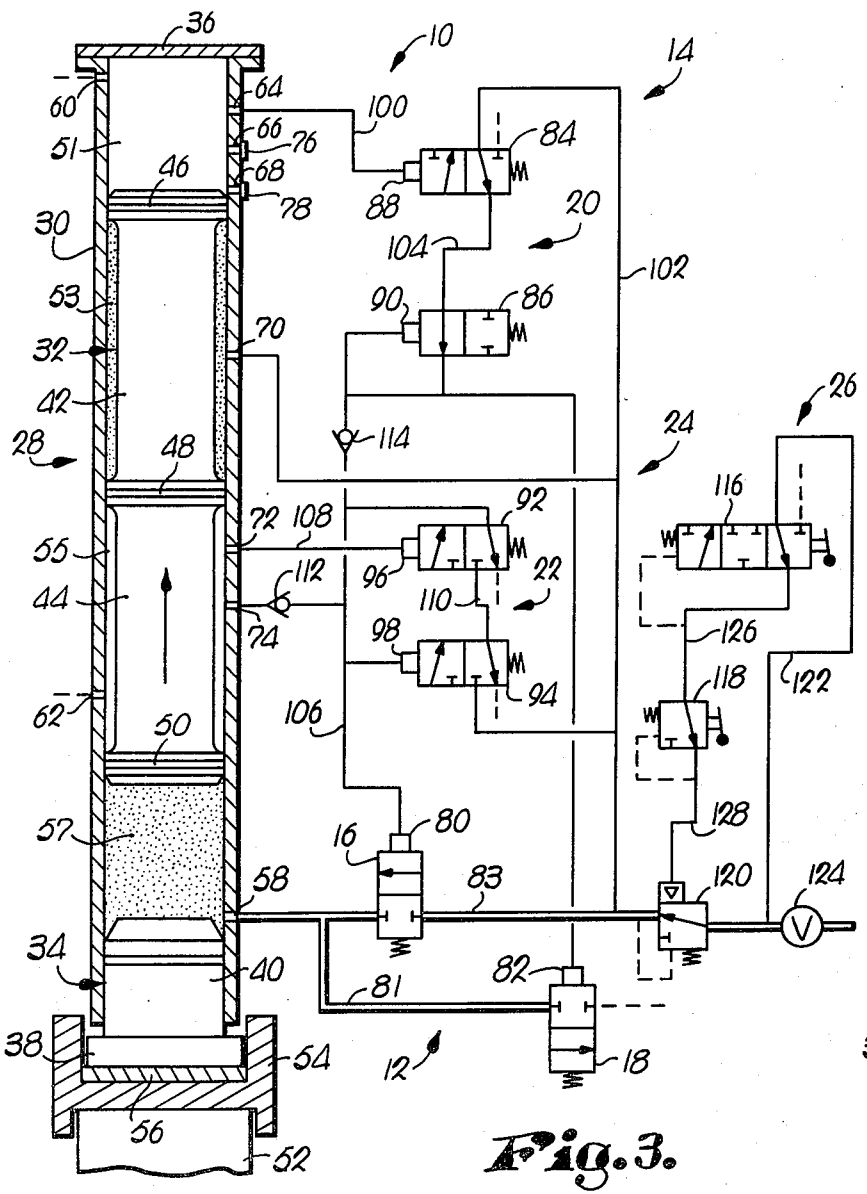
FIG. 3 is similar to FIG. 1 but shows the control system and pile hammer in their respective configurations with the hammer piston partially raised.

The next step in the control system operational sequence occurs when the middle ring 48 of the piston 32 rises above orifice 72 (FIG. 3). With the middle ring 48 above the orifice 72, the pressure supplied through orifice 70 no longer is transmitted through the orifices 72 and 74. The pressure that had been applied to the pilot 96 of valve 92 is exhausted through orifice 62, causing the valve 92 to return to its normally closed position. With the valve 92 in its closed position, pressure applied to the pilot 98 of the valve 94 and the pilot 80 of valve 16 is exhausted through the valve 92, and the valves 94, 16 return to their normally closed position. Once the pressure is released from the pilot 80 of air supply valve 16, the valve 16 closes and pressure is no longer applied through orifice 58. Even though pressurized motive fluid is no longer applied through orifice 58 once the valve 16 is closed, the piston 32 will continue to rise due to its own momentum and due to the continued expansion of the fluid within the housing 30. During this step of the operation the valve 86 is kept in an open position due to the pressure applied to the pilot 90 of valve 86 through the closed loop defined by the portion of fourth conduit 106 between second valve 86 and the pilot 90 of second valve 86. Check valve 114 isolates the pilot 80 of the valve 16 from the signal pressure being applied to the pilot 90 of the valve 86. With the valves 84, 86 in an open position during this step of the operation, pressure continues to be applied to the pilot valve 82 of exhaust valve 18, keeping the valve 18 in a closed position.

Figure 4:
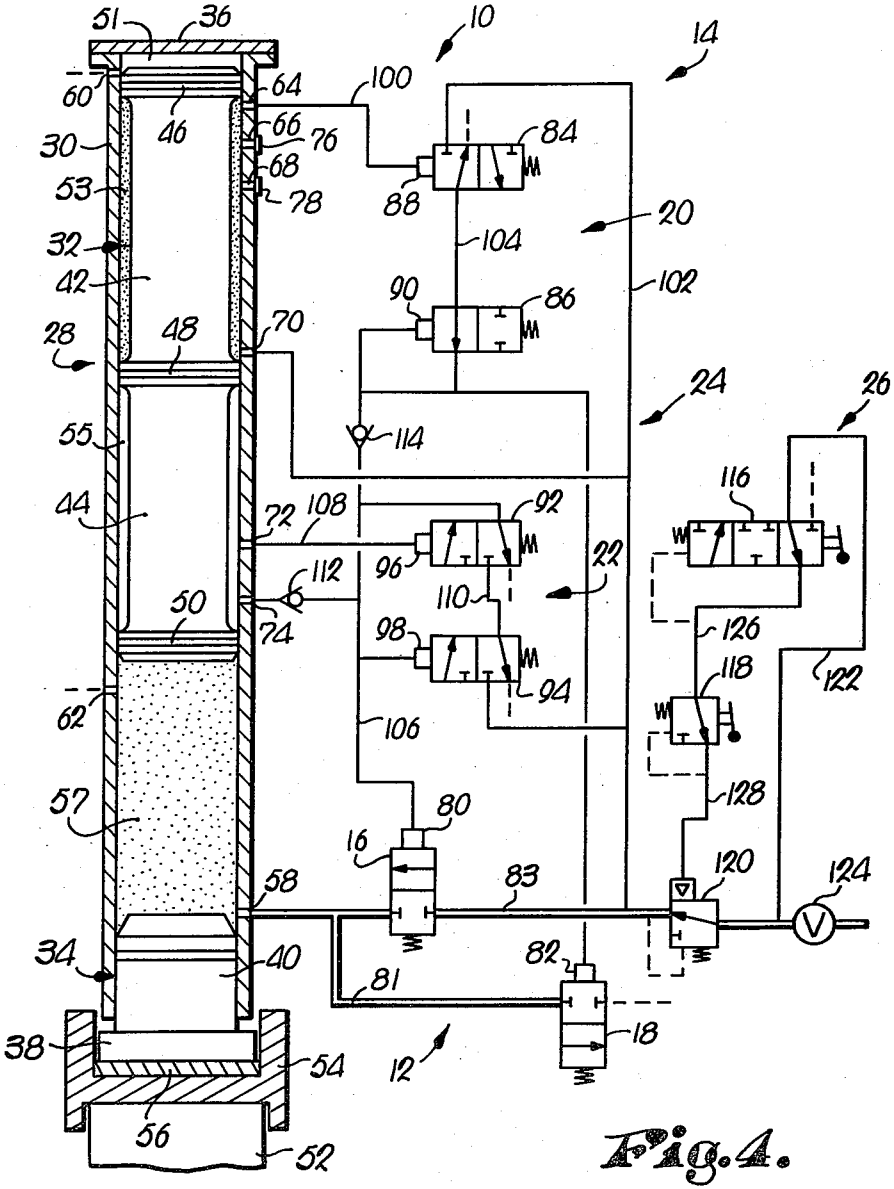
FIG. 4 is similar to FIG. 1 but shows the control system and pile hammer in their respective configuration with the hammer piston fully raised, just prior to opening of the exhaust valve.
Figure 5:
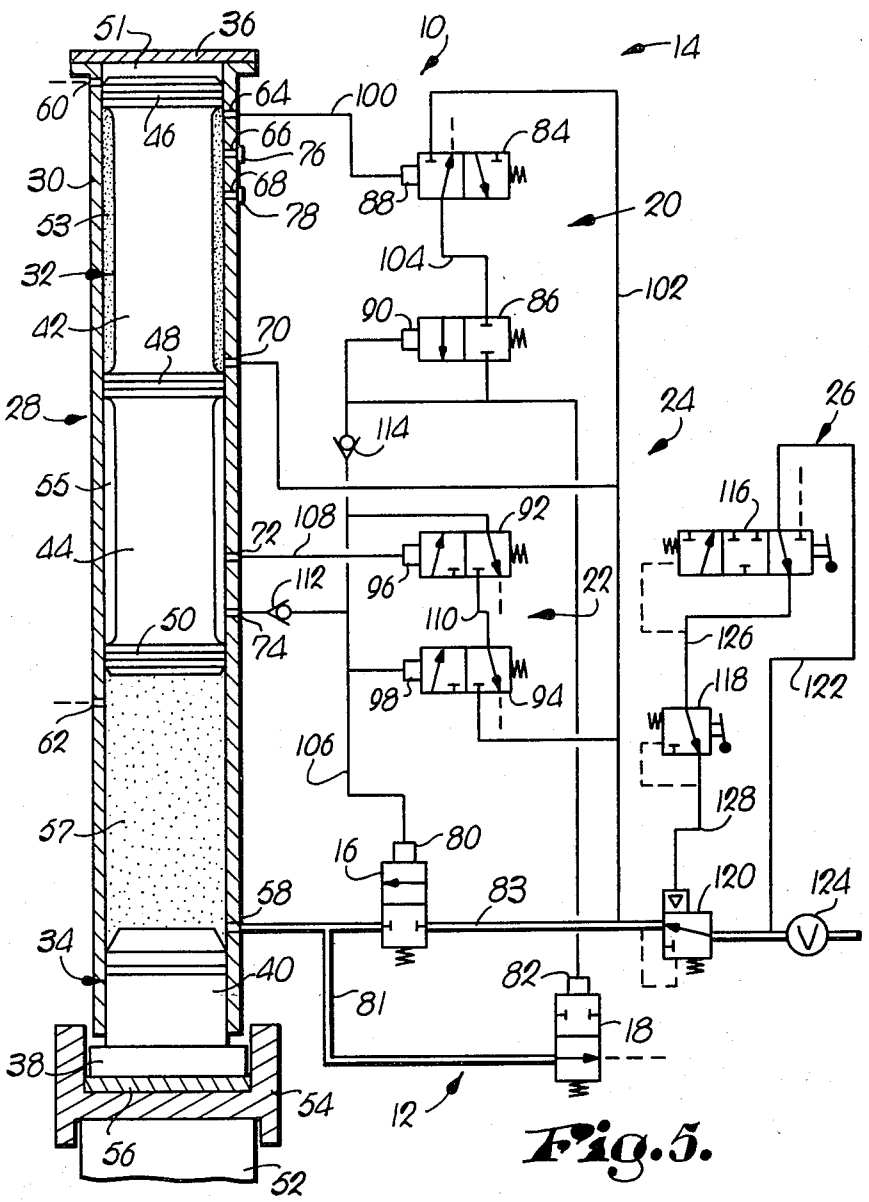
FIG. 5 is similar to FIG. 4 but shows the control system just after the exhaust valve is open.

Referring to FIGS. 4 and 5, the next step in the operational sequence occurs when the piston 32 is raised to its fully extended position within the housing 30. At that time, pressure applied through orifice 70 is transmitted through cavity 53, orifice 64, and conduit 100 to the pilot 88 of the valve 84, causing the valve 84 to switch to a closed position. With the valve 84 in a closed position, the pressure applied to the pilot 82 of exhaust valve 18 is exhausted through the valve 84, 86. When the pressure is exhausted from the pilot 82 of exhaust valve 18, valve 18 switches to its normally open position (FIG. 5), allowing the fluid in the hammer housing 30 to exhaust, and the hammer piston 32 descends. It should be noted that when valve 84 is switched to the closed position, the pressure applied to pilot 90 of valve 86 vents simultaneously with the pressure applied to pilot 82 of exhaust valve 18, and valve 86 switches to its normally closed position.

Figure 6:
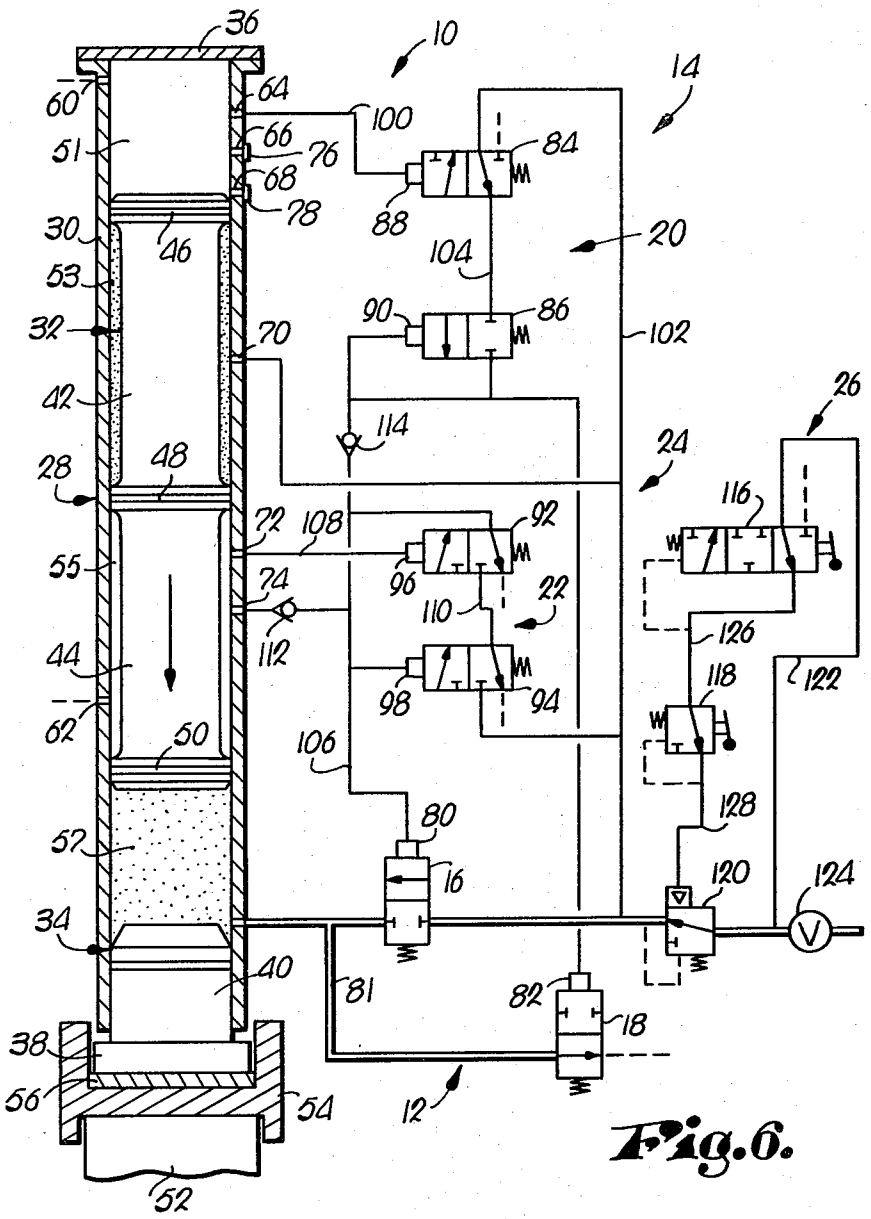
FIG. 6 is similar to FIG. 1 but shows the control system and the pile hammer in their respective configurations with the hammer piston in a partially down position.

Referring to FIG. 6, the piston 32 is shown partially descended within the housing 30. When the ring 46 of piston 32 falls below piston fully raised sensing orifice 64, pressure is no longer applied through orifice 70, cavity 53, orifice 64, and conduit 100 to the pilot 88 of the valve 84. Pressure previously applied to pilot 88 of valve 84 is exhausted through the port 60. As is clearly seen in FIG. 6, no pressure is applied to the pilot 80 of the valve 16 or the pilot 82 of the valve 18 while the piston 32 descends within the housing 30. The valve 16 is therefore in its normally closed position while the piston 32 descends, and the valve 18 is in its normally open position, and the fluid within the housing 30 between the anvil 40 and the piston 32 freely exhausts through the conduit 81. Once the piston 32 has fully descended, the ring 48 of piston 32 will be below the orifice 74. Once the ring 48 of piston 32 is below the orifice 74, pressure can again be applied through orifices 72 and 74 as described above and the operation sequence described above begun anew.

It will be perceived by those skilled in the art that the use of two valves in each of the valve control means 20, 22 facilitates the opening and closing of the controlled valves (supply valve 16 and exhaust valve 18) relative to different positions of the piston 32 within the housing 30. That is to say, for instance, the supply valve 16 can be switched from its normally closed to an open position when the piston 32 is at one particular position in the housing 30, and can be switched back to its normally closed position when the piston 32 is at a different position within the housing 30. In particular, and referring to FIGS. 2 and 3, it will be noticed that until the ring 48 of piston 32 is above the hammer partially raised sensing orifice 72, supply valve 16 is maintained in an open position by the pressure applied to the pilot 80 of supply valve 16 through conduit 102, fourth valve 94, conduit 110, third valve 92, and conduit 106. Once ring 48 of piston 32 has risen above the hammer partially raised sensing orifice 72, third valve 92 returns to its normally closed position and the pressure applied to the pilot 80 of supply valve 16 is vented, and supply valve 16 is closed. The supply valve 16 will not be switched to an open position once the ring 48 of the piston 32 has fallen below the piston partially raised sensing orifice 72, but will only switch to the open position when the ring 48 of piston 32 has fallen below the hammer fully down sensing orifice 74. In a like manner, the two valves 84, 86 of the exhaust valve control means 20 interact such that exhaust valve 18 is switched to a closed position when the piston 32 is at one position within the housing 30, and is maintained in the closed position until the piston 32 has reached a different position within the housing 30.

It will be noted from the above discussion that the exhaust valve 18 is not switched from a closed position to an open position until the ring 46 of piston 32 is above the orifice 64, thereby allowing pressure to be applied to the pilot 88 of valve 84. Those skilled in the art will perceive that merely lowering the position of orifice 64 will decrease the operational stroke length of piston 32. This lowering effect is accomplished by connecting the conduit 100 to either orifice 66 or 68 depending on the stroke length desired.

As described above, pressure regulation system 26 has two pressure regulation valves 116 and 118. The valve 118 is set at a predetermined pressure and acts as a safety mechanism to prevent the pressure of the fluid applied to the control system 10 to rise above the predetermined maximum to which valve 118 is set. The valve 116 is used to vary the pressure of the fluid applied to the control system 10 from zero pounds per square inch up to the operating maximum to which valve 118 is set. The pressure regulation system 26 is a low volume fluid loop. The valve 120 imparts the pressure set within the low volume loop regulation system 26 to the high volume of the fluid applied to the motive fluid valve assembly 12.

It will be apparent to those skilled in the art that so long as the pressure regulation valve 116 is set such that fluid is applied to the control system 10 and pile hammer 28 at a constant pressure, the operational sequence described above will automatically repeat itself. It is a novel feature of the control system 10 in accordance with the present invention that a pile hammer 28 may be operated in conjunction with the control system 10 in a single stroke mode whereby the stroke length of the piston 32 within the hammer housing 30 can be varied in accordance with the amount of pressure applied to the system 10. When operated in the single stroke mode the valve 116 may be manually manipulated to apply a short burst of pressurized fluid to the control system 10 and the pile hammer 28 such that the piston 32 is partially raised. If the pressure regulation valve 116 is then returned to a closed position the delivery of pressurized fluid to the control system 10 and pile hammer 30 will cease, and the pressure of the fluid in the control system will reduce to zero. With the pressure of the fluid in the control system reduced to zero, valves 86, 92, 94, 80 will return by spring bias to their normally closed position and the valves 84, 18 will return by spring bias to their normally open position. It will be noted that in this configuration the supply valve 16 is closed and the exhaust valve 18 is open, and the fluid within the housing 30 between the anvil 40 and the piston 32 will exhaust through the valve 18, allowing the piston 32 to descend.

We claim:

1. A pressurized fluid control system for a pile hammer, said hammer including an elongated, tubular housing, said housing including structure defining a supply/exhaust port, first and second control air vents, a control air supply port, a plurality of hammer fully raised sensing orifices, a hammer partially raised sensing orifice and a hammer fully down sensing orifice, an axially shiftable piston disposed within said housing, means including a motive fluid conduit and a pressurized fluid source operatively connected to said housing for shifting said piston within said housing, said control system comprising:

a motive fluid valve assembly, said assembly including:

a supply valve operatively coupled to said motive fluid conduit for controlling flow of motive fluid into said housing; and an exhaust valve operatively coupled to said housing for controlling discharge of fluid from the housing; and a control assembly for controlling the opening and closing of said supply and exhaust valves in response to the position of said piston within said housing, including control valve means and a plurality of control fluid conduits operatively coupling said control valve means, housing, and motive fluid valve assembly, said control valve means comprising first, second, third and fourth control valves, each of said control valves including a pressure sensitive pilot;

said supply valve and said exhaust valve including a pressure sensitive pilot; and said control fluid conduits including:

a first conduit selectively connecting one of said hammer fully raised sensing orifices and said pilot of said first control valve;

a second conduit connecting said pressurized fluid source and said first control valve, said control air supply port and said fourth control valve;

a third conduit connecting said first control valve and said control valve;

a fourth conduit connecting said hammer fully down sensing orifice and said pilot of said second control valve, said second control valve, said third control valve, said pilot of said fourth control valve, said pilot of said supply valve and said pilot of said exhaust valve;

a fifth conduit connecting said hammer partially raised sensing orifice and said pilot of said third control valve;

a sixth conduit connecting said third control and fourth control valves.

2. A control system as in claim 1, said system further including a pressure regulation means connected to said control system, said regulation system including:

a first regulator valve;

a second regulator valve;

system fluid supply valve;

a seventh conduit connecting said first pressure regulator valve, and said system fluid supply valve to said fluid source;

an eighth conduit connecting said first and second regulator valves; and a ninth conduit connecting said second regulator valve with said system fluid supply valve.

3. In combination:

a pile hammer, said hammer including an elongated, tubular housing with structure defining a plurality of orifices, an axially shiftable piston disposed within said housing, means including motive fluid transmission conduit and a pressurized fluid source operatively connected to said housing for shifting said piston within said housing; and a control system actuated by a pressurized fluid, and operatively connected to said pile hammer for controlling the operation of said pile hammer, said control system including:

a motive fluid valve assembly, said assembly including a supply valve operatively coupled to said motive fluid conduit for controlling flow of motive fluid into said housing; and an exhaust valve operatively coupled to said housing for controlling discharge of fluid from the housing; and a control assembly for controlling the opening and closing of said supply and exhaust valves in response to the position of said piston within said housing, including control valve means and a plurality of control fluid conduits operatively coupling said control valve means, housing, and motive fluid valve assembly, said control valve means comprising an exhaust valve control means and a supply valve control means, said supply valve means comprising a control valve for controlling the closing of said supply valve when said piston has been shifted through a predetermined portion of travel of said housing, and a control valve for selectively maintaining said supply valve in an open position during a predetermined portion of the travel of said shiftable piston with said housing.

* * * * *